US006486765B1

(12) United States Patent
Katayanagi

(10) Patent No.: US 6,486,765 B1
(45) Date of Patent: Nov. 26, 2002

(54) TRANSFORMER

(75) Inventor: Tetsuo Katayanagi, Tokyo (JP)

(73) Assignee: Oki Electric Industry Co, Ltd., Tokyo (JP)

( * ) Notice: Subject to any disclaimer, the term of this patent is extended or adjusted under 35 U.S.C. 154(b) by 0 days.

(21) Appl. No.: 09/532,031

(22) Filed: Mar. 21, 2000

(30) Foreign Application Priority Data

Sep. 17, 1999 (JP) ..... 11-263466

(51) Int. Cl.[7] ..... H01F 27/28
(52) U.S. Cl. ..... 336/182; 336/200; 336/223
(58) Field of Search ..... 336/200, 223, 336/232, 214, 222, 199

(56) References Cited

U.S. PATENT DOCUMENTS 4,999,597 A * 3/1991 Gaynor ..... 333/246
5,831,331 A * 11/1998 Lee ..... 257/659
5,969,590 A * 10/1999 Gutierrez ..... 336/200
6,060,976 A * 5/2000 Yamaguchi et al. ..... 336/200

OTHER PUBLICATIONS

Shimoda, et al.; "Electromagnetics"; pp. 214–216, No Date.

* cited by examiner

*Primary Examiner*—Lincoln Donovan
*Assistant Examiner*—Kyung S. Lee
(74) *Attorney, Agent, or Firm*—Rabin & Berdo, P.C.

(57) ABSTRACT

The invention provides a transformer suitable for use in a high frequency semiconductor device, and the transformer can be formed without the use of a conventional core and coils by forming at least two spiral inductors selected from a plurality of spiral inductors on a semiconductor substrate so as to overlap each other substantially in the vertical direction with an interlayer insulator interposed in between.

10 Claims, 3 Drawing Sheets

TRANSFORMER

BACKGROUND OF THE INVENTION

1. Field of the Invention

The present invention relates to a transformer suitable for use in a semiconductor device, and particularly, to a transformer for use in a high frequency semiconductor device inside a monolithic microwave integrated circuit (MMIC), and the like, that is used in a fast radio transmission system, and so forth.

2. Description of the Related Art

There has been described a conventional transformer in a literature, the college text, "Electromagnetics", by Koichi Shimoda and Soshin Ckikazumi, pp. 214, 216. FIG. 1 is a view broadly showing a conventional transformer described in the literature mentioned above. Referring to the figure, the conventional transformer is described hereinafter. Reference numeral 21 denotes a primary coil, 22 a secondary coil, and 23 a core. The primary coil 21 and secondary coil 22 are wound round the core 23.

Now, the operation is described hereinafter. Flow of alternating current in the primary coil 21 causes magnetic fluxes to be induced in the core 23, whereupon an electromotive force is generated in the secondary coil 22 by the agency of the magnetic fluxes induced.

SUMMARY OF THE INVENTION

It is an object of the invention to provide a transformer that can be applied to a high frequency semiconductor device, and the like. The transformer can be formed without the use of a conventional core and coils by forming at least two spiral inductors selected from a plurality of spiral inductors on a semiconductor substrate so as to overlap each other substantially in the vertical direction with an interlayer insulator interposed therebetween.

According to the invention, a transformer can be implemented without the use of a core and coils by forming a plurality of spiral inductors on a semiconductor substrate, and by forming at least two spiral inductors selected from the plurality of the spiral inductors so as to overlap each other substantially in the vertical direction to the substrate with an interlayer insulator interposed therebetween such that at least the two spiral inductors are insulated from each other in terms of d.c., but continuous with each other in terms of a high frequency wave.

Further, the transformer with the features described above may be formed wherein at least the two spiral inductors selected from the plurality of the spiral inductors are formed in the shape of a rectangle such that the rectangles overlap each other along the longer sides thereof, so that advantageous effects of mutual inductance can be enhanced by enlarging an area of overlapping portions without enlarging areas of elements.

DETAILED DESCRIPTION OF THE PREFERRED EMBODIMENTS

Figure 1:
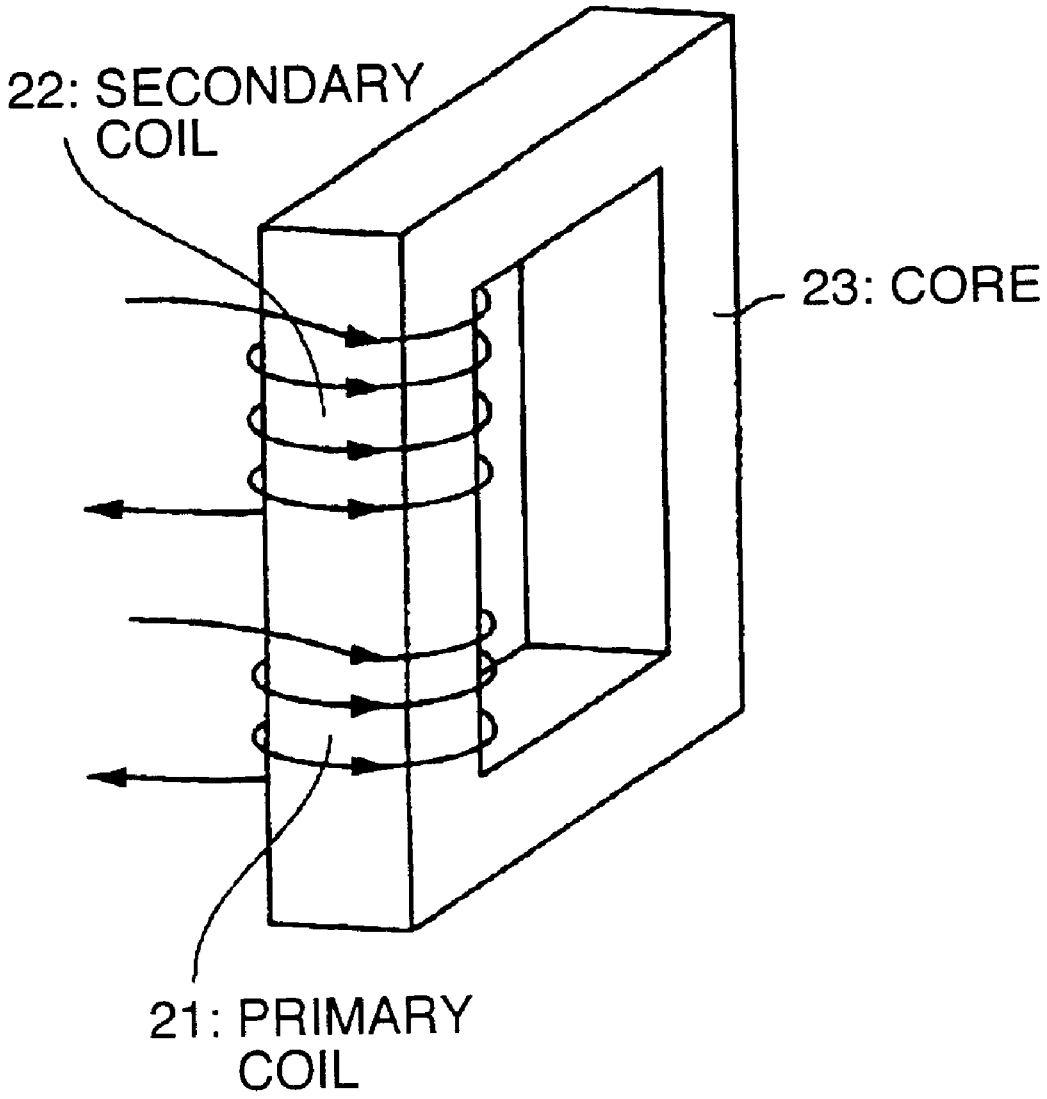
FIG. 1 (PRIOR ART)
FIG. 1 is a view broadly showing a conventional transformer.
Figure 2:
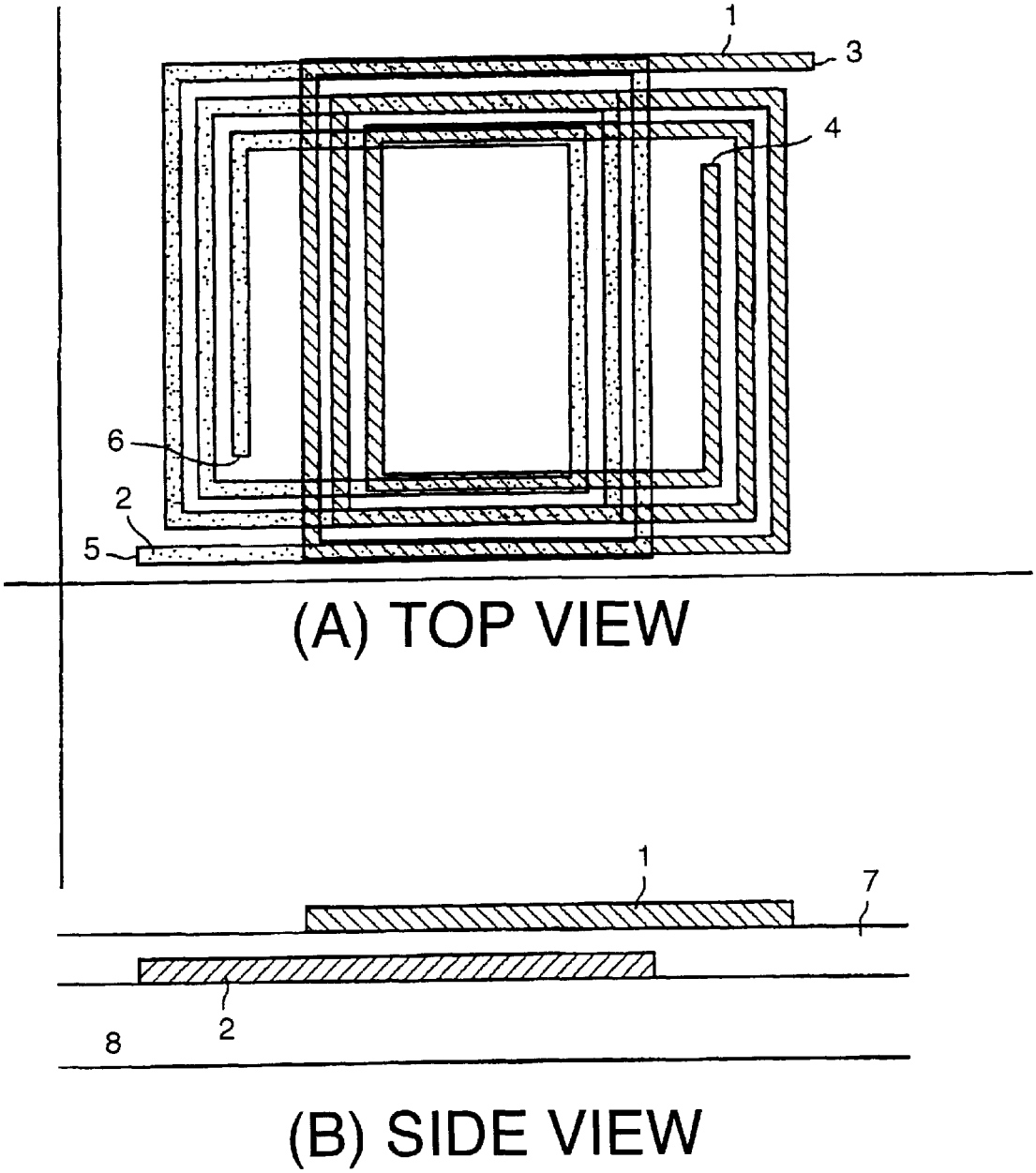
FIG. 2 is a schematic representation illustrating a first embodiment of a transformer according to the invention.
Figure 3:
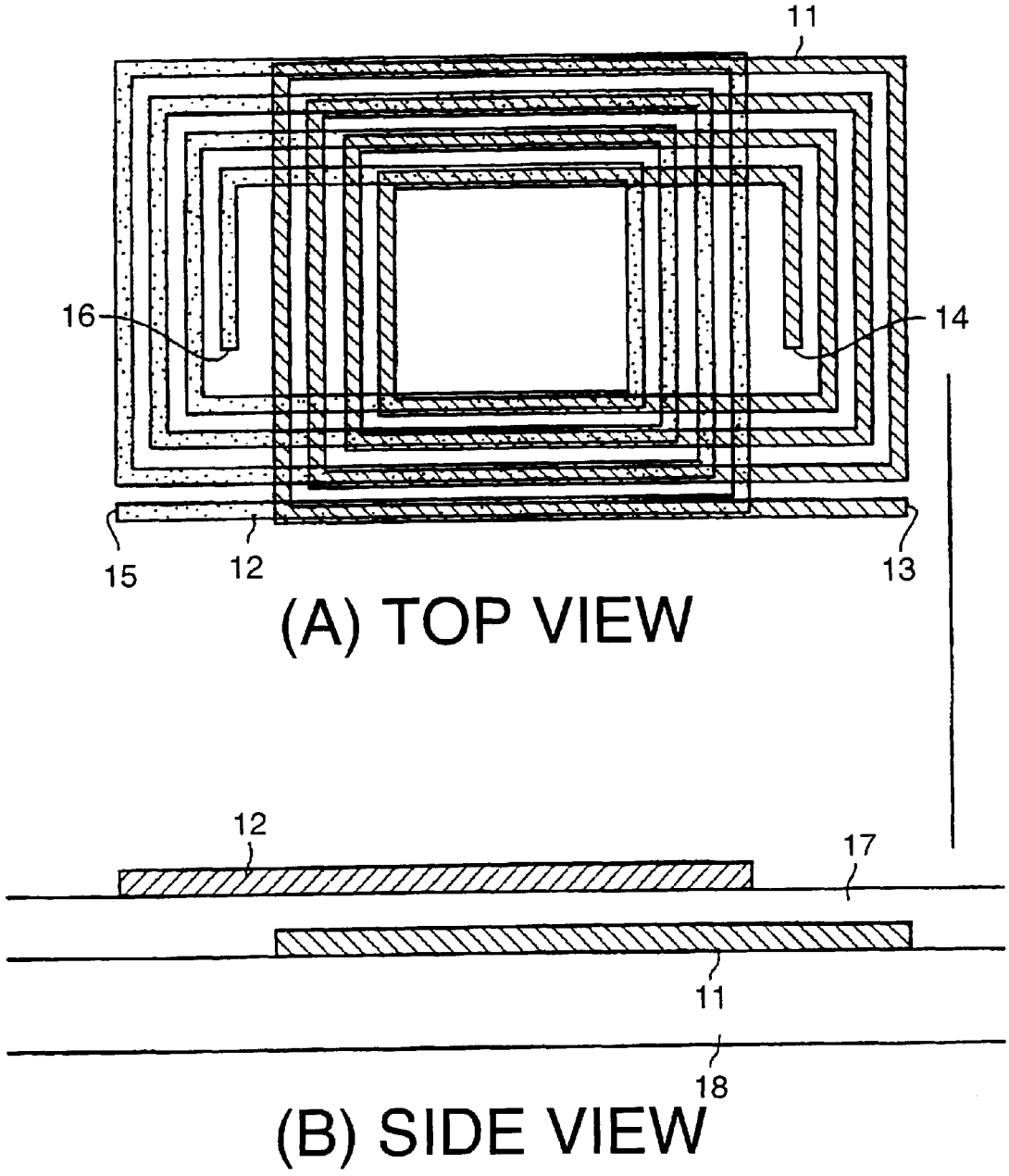
FIG. 3 is a schematic representation illustrating a second embodiment of a transformer according to the invention

FIGS. 2 and 3 are schematic representations illustrating embodiments of a transformer according to the invention.

The embodiments of the invention will be described hereinafter with reference to FIGS. 2 and 3.

In FIG. 2 as well as FIG. 3, respective spiral inductors are insulated from each other in terms of d.c., but continuous with each other in terms of a high frequency wave. Magnetic fluxes are induced by the flow of electric current in one of the spiral inductors, whereupon an electromotive force having any suitable current and voltage can be caused to occur in the other of the spiral inductors through mutual induction. Accordingly, any suitable current and voltage can be generated by a single power supply source without the use of a plurality of power supply sources, and the like.

Not less than two of the spiral inductors are sufficient. Optional current values and voltage values can be obtained by varying the number of turns and an overlapping manner with respect to the spiral inductor in which electric current flows, and the spiral inductor in which the electromotive force is induced.

The embodiments wherein two of the spiral inductors are used are described hereinafter, however, it is evident that three or more of the spiral inductors may be used instead.

FIG. 2 is a view showing a first embodiment of a transformer according to the invention. The first embodiment is described hereinafter with reference to FIG. 2.

Reference numeral 1 is a primary spiral inductor, and is formed of a first layer wiring over a semiconductor substrate 8. Reference numeral 2 is a secondary spiral inductor, and is formed of a second layer wiring. Reference numeral 3 is a connection terminal for the primary spiral inductor, and is connected to the second layer wiring (not shown). Reference numeral 5 is a connection terminal for the secondary spiral inductor, and is connected to the first layer wiring (not shown). Reference numeral 7 is an interlayer insulator for insulating the first layer wiring from the second layer wiring.

Now, the operation is described hereinafter. Both the primary spiral inductor and the secondary spiral inductor have inductance at a value, respectively. When electric current flows in the primary spiral inductor, magnetic fluxes are induced. An electromotive force is generated in portions of the secondary spiral inductor, where the primary spiral inductor and the secondary spiral inductor overlap each other, by the agency of the magnetic fluxes, and thereby electric current is caused to flow in the secondary spiral inductor, thereby enabling such a constitution as described to function as a transformer.

Thus, according to the first embodiment of the invention, it becomes possible to form a transformer on top of a high frequency semiconductor device of a MMIC, or the like by installing a plurality of the spiral inductors formed so as to overlap each other on a semiconductor device.

FIG. 3 is a view showing a second embodiment of a transformer according to the invention. The second embodiment is described hereinafter with reference to FIG. 3.

Reference numeral 11 is a primary spiral inductor, and is formed of a first layer wiring over a semiconductor substrate 18. Reference numeral 12 is a secondary spiral inductor, and is formed of a second layer wiring. Reference numeral 13 is a connection terminal for the primary spiral inductor, and is connected to the second layer wiring (not shown). Reference numeral 15 is a connection terminal for the secondary spiral inductor, and is connected to the first layer wiring (not shown). Reference numeral 17 is an interlayer insulator for insulating the first layer wiring from the second layer wiring.

Normally, the spiral inductors are often formed substantially in the shape of a square but, in this case, are formed in the shape of a rectangle on purpose.

Now, the operation is described hereinafter. Both the primary spiral inductor and the secondary spiral inductor have inductance at a value, respectively. When electric current flows in the primary spiral inductor, magnetic fluxes are induced. An electromotive force is generated in portions of the secondary spiral inductor, where the primary spiral inductor and the secondary spiral inductor overlap each other, by the agency of the magnetic fluxes induced, and thereby electric current is caused to flow in the secondary spiral inductor, thereby enabling such a constitution as described to function as a transformer. With this embodiment, since both of the spiral inductors are rectangular in shape, an area of the portions of the secondary spiral inductor, where the primary spiral inductor and the secondary spiral inductor overlap each other, becomes greater than that in the case of the first embodiment, and thereby a transfer efficiency from the primary spiral inductor to the secondary spiral inductor is improved on that for the first embodiment.

Thus, according to the second embodiment of the invention, it is possible to further improve the transfer efficiency without enlarging an area of elements by forming the spiral inductors in the shape of a rectangle in addition to advantageous effects of the first embodiment gained by installing the plurality of the spiral inductors formed so as to overlap each other on a semiconductor device.

With reference to the first and second embodiments described above, a specific case where two of the spiral inductors are used is described, however, it is to be pointed out that there are no limitations whatsoever as to the number of turns of the respective spiral inductors, width thereof, and so forth.

Further, output from the connection terminals may be taken out via wiring in any suitable layer through contact holes, or the like, and a manner in which the output from the connection terminals are taken out is not limited to that according to the first or second embodiment.

What is claimed is:

1. A transformer comprising a plurality of spiral inductors formed on a semiconductor substrate, wherein at least two spiral inductors selected from the plurality of the spiral inductors are formed so as to partially overlap each other with an interlayer insulator interposed therebetween, and wherein each of the at least two spiral inductors has output terminals and the output terminals are at ends of the at least two spiral inductors which non-overlap each other.

2. A transformer according to claim 1, wherein the at least two spiral inductors selected from the plurality of the spiral inductors are formed in the shape of a rectangle such that the rectangles overlap each other along the longer sides thereof.

3. A transformer according to claim 1, wherein the interlayer insulator electrically insulates the at least two spiral inductors from each other.

4. A transformer according to claim 1, wherein the at least two spiral inductors each have two or more turns, the two or more turns all spiraling inward in a same direction.

5. A transformer comprising a semiconductor substrate;

a first spiral inductor formed on the semiconductor substrate, the first spiral inductor having output terminals at ends thereof, a second spiral inductor partially overlapping the first spiral inductor and having output terminals at ends thereof, the second spiral inductor being laterally displaced relative to the first spiral inductor so as to be partially nonoverlapping with the first spiral inductor, the ends of the second spiral inductor being nonoverlapping with the ends of the first spiral inductor; and an interlayer insulator interposed between the first and second spiral insulators.

6. A transformer according to claim 4, wherein the interlayer insulator electrically insulates the first and second spiral inductors from each other.

7. A transformer, comprising:

a semiconductor substrate;

a first spiral inductor formed on the semiconductor substrate, the first spiral inductor having an input terminal at an end thereof;

a second spiral inductor partially overlapping the first spiral inductor, and laterally displaced relative to the first spiral inductor so as to be partially nonoverlapping with the first spiral inductor, the second spiral inductor having an output terminal at an end thereof; and an interlayer insulator interposed between the first and second spiral insulators;

wherein the first and second spiral inductors each have a rectangular shape, each having opposing, longitudinally extending, first and second longer sides, the first longer sides of the first and second spiral inductors being vertically aligned so as to partially overlap, the second longer sides of the first and second spiral inductors being vertically aligned so as to partially overlap, the second spiral inductor being displaced longitudinally relative to the first spiral inductor so that the first longer sides of the first and second spiral inductors are partially nonoverlapping and the second longer sides of the first and second spiral inductors are partially nonoverlapping.

8. A transformer according to claim 7, wherein the output terminals are at ends of the first and second spiral inductor nonoverlapping each other.

9. A transformer according to claim 8, wherein the output terminals are at ends of nonoverlapping portions of the first longer sides first and second spiral inductors.

10. A transformer according to claim 7, wherein each of the longer sides of the first spiral inductor has an end overlapped by one of the longer sides of the second spiral inductor and an end nonoverlapped by the longer sides of the second spiral inductor and each of the longer sides of the second spiral inductor has an end overlapped by one of the longer sides of the first spiral inductor and an end nonoverlapped by the longer sides of the first spiral inductor, the output terminal of the first spiral inductor being at the nonoverlapping end of one of the longer sides of the first spiral inductor, the output terminal of the second spiral inductor being at the nonoverlapping end of one of the longer sides of the second spiral inductor.

* * * * *